United States Patent [19]

Schreter

[11] Patent Number: 4,688,496

[45] Date of Patent: Aug. 25, 1987

[54] PULVERIZED COAL BURNER

[75] Inventor: Robert E. Schreter, Roswell, Ga.

[73] Assignee: Enatech Corporation, Kennesaw, Ga.

[21] Appl. No.: 888,639

[22] Filed: Jul. 28, 1986

Related U.S. Application Data

[63] Continuation of Ser. No. 759,338, Jul. 26, 1985, abandoned.

[51] Int. Cl.[4] ..... F23D 1/02

[52] U.S. Cl. ..... 110/264; 110/347; 431/184; 431/284

[58] Field of Search ..... 110/264, 265, 347; 431/182, 183, 184, 284; 239/404, 405

[56] References Cited

U.S. PATENT DOCUMENTS

| | | | |
|---|---|---|---|
| 4,223,615 | 9/1980 | Breen et al. | 110/264 |
| 4,333,405 | 6/1982 | Michelfelder et al. | 110/264 |
| 4,387,654 | 6/1983 | Binasik et al. | 110/265 X |
| 4,457,241 | 7/1984 | Itse et al. | 110/264 |
| 4,515,090 | 5/1985 | Brashears et al. | 110/264 |
| 4,517,904 | 4/1985 | Penterson et al. | 110/264 |

*Primary Examiner*—Edward G. Favors

*Attorney, Agent, or Firm*—Rodgers & Rodgers

[57] ABSTRACT

The flame established in the combustion chamber is short in the direction of material flow and of tornado configuration due in part to swirling in spiral fashion of primary air bearing pulverized coal particles along a conduit together with swirling in spiral fashion of secondary or combustion air along a conduit which is concentrically arranged with respect to the primary air and coal particle conduit so that these two flame components are dispersed in a transversely outward manner due to centrifugal force and for wall jet attraction and by this means the longitudinal length customarily necessary for high temperature pulverized coal burners is substantially shortened and the temperature at which combustion may take place is substantially reduced.

14 Claims, 9 Drawing Figures

PULVERIZED COAL BURNER

This is a continuation of application Ser. No. 759,338 filed July 26, 1985 now abandoned.

TECHNICAL FIELD

This invention relates to pulverized coal burners which are adapted to operate at low temperatures in conjunction with dryers, kilns, furnaces, and heaters which in the past have been fired using natural gas and fuel oils.

BACKGROUND ART

Low temperature drying and heating apparatus of known construction utilizes enormous quantities of fuel which ordinarily is in the form of natural gas or fuel oil, prices of which have increased substantially in recent years.

Combustion of all liquid or solid fuels requires that the fuel be gasified before being burned. In the case of a liquid fuel, the fuel is normally atomized to reduce particle size. Most heat transfer within the flame is by radiation with convection playing a minor role. However, in either case surface area plays a major part in heat transfer and in the rate of evaporation. Burning time of a particle is dependent on the rate of evaporation or gasification.

In the case of solid fuels, gasification of the volatile portions of the solid fuel act much like the gasification of atomized fuels. However the carbon or solid portion must be heated so that carbon on the surface of the coal particle combines with oxygen forming carbon monoxide which burns. Again particle size, i.e., surface to mass ratio, are very important factors which control burn time.

Intimate mixing of coal particles with air is also another critical factor in the rate of reaction and the burning time of pulverized coal. Conventional coal burners introduce pulverized coal in rather concentrated streams which mix slowly thereby producing relatively long flames having slow reaction rate.

Rate of reaction is effected by the temperature of the reaction. Therefore it is advisable to maintain high temperatures in the reaction zone of any furnace, oven or dryer. Unfortunately known low temperature ovens or furnaces do not lend themselves to providing the necessary high temperature combustion zone required to burn coal efficiently.

DISCLOSURE OF THE INVENTION

According to this invention in one form, a pulverized coal burner is provided which can burn cleanly at relatively low temperatures as well as at high temperatures while utilizing coal as a principal fuel and which is relatively low in cost compared to liquid fuels. The result of this invention is achieved without increasing the length of the dryer due to the provision of a novel flame shape which is short in the direction of fuel flow due to a swirling, cyclonic or tornado like action of primary air conveying coal particles and to a swirling or cyclonic like action of secondary or combusion air supplied along a conduit which is concentric with respect to the primary air and coal conduit so that upon entering the combustion chamber these two quantities are forced transversely outward due to centrifugal action and wall jet attachment so that the flame becomes relatively large in the transverse direction but of much shorter length in the longitudinal direction or the direction in which the components of combustion are fed into the combustion chamber. This short flame is accompanied by intense mixing and a high reaction rate.

According to a feature of the invention, the ratio of angular or swirling momentum flux to the axial momentum flux, when in dimensionless form, of the combustion air is at least 0.6 and in like fashion the ratio of angular or swirling momentum flux to the axial momentum flux of the primary air and pulverized coal is in excess of 0.6.

BEST MODE OF CARRYING OUT THE INVENTION

Figure 1:
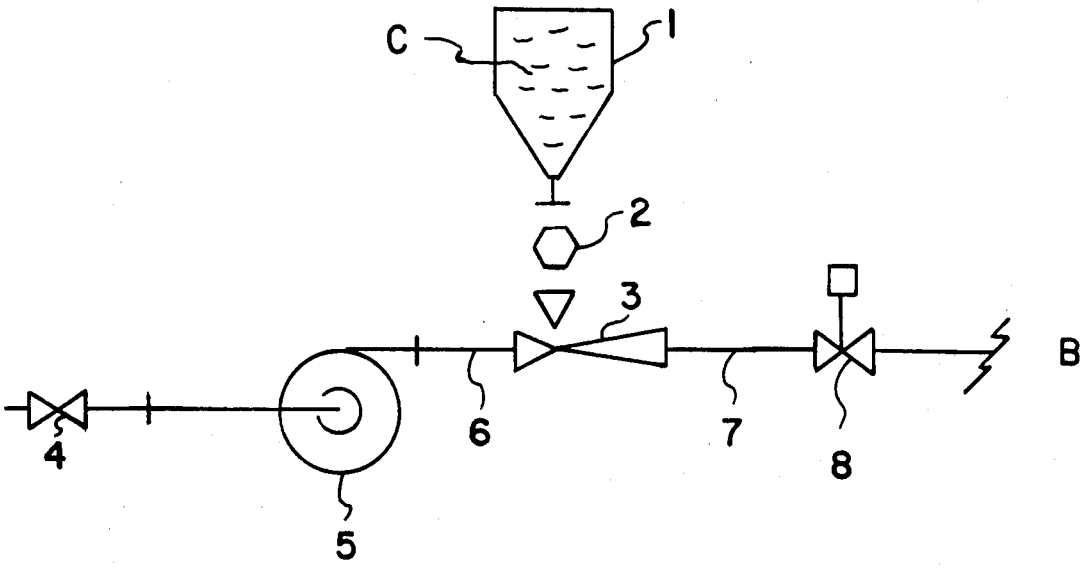
FIG. 1 is a schematic representation of a conventional system for injecting pulverized coal particles into a stream of primary air in a controlled fashion prior to entry of this mixture into a burner for pulverized coal.

A mixture of pulverized coal and primary air is fed to a coal burner B by the conventional system depicted in FIG. 1. In FIG. 1 the pulverized coal C is contained within a dispenser 1 and discharged through a metering device 2 into a venturi 3. A source of air is supplied through air valve 4 and blower 5 to venturi 3 through conduit 6 and thence through conduit 7 to safety valve 8 and in turn to burner B.

Figure 2:
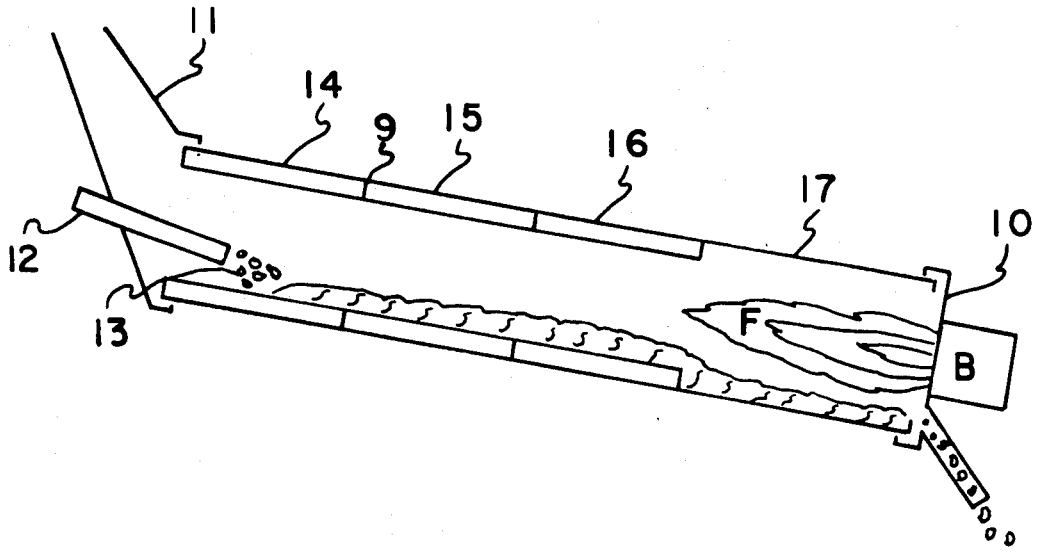
FIG. 2 is a schematic representation of a conventional aggregate dryer which utilizes liquid fuel and which is characterized by a flame which is disadvantageously long.

In FIG. 2 a rotary dryer 9 is used in conjunction with a conventional pulverized coal burner B. As previously explained, a conventional coal burner such as B provides a long flame F. Burner B is interrelated with stationary hood 10 and exhaust gases are collected and discharged by stationary hood 11. Wet aggregate to be dried is supplied to the interior of cylinder 9 by means of conduit 12 and is indicated at 13. Veiling flights 14, 15 and 16 are utilized to facilitate showering of the aggregate material through the hot gases produced by burner B.

Conventional dryers such as shown in FIG. 2 are provided with an area 17 which is free from veiling and which allows enough volume and length to permit the fuel to be burned. Should this unveiled portion 17 of cylinder 9 be inadequate or if aggregate material is showered through the reaction portion of the flame incomplete combustion results. Installation of pulverized coal burners in conjunction with existing aggregate dryers results in a flame F which is certain to encroach on the veiling area thereby creating incomplete combustion which is generally unacceptable because of inefficiency of fuel combustion but which also results in a loss of production resulting from the quenched flame.

An alternative would be to lengthen the combustion zone 17 by removing part of the veiling such for example as veiling 16. Since veiling and its exposure of surface areas is vital to productivity, any reduction of the veiling zone appreciably reduces dryer productivity.

According to this invention, a pulverized coal burner is provided which functions efficiently in an aggregate or drum dryer, air heater, furnace and the like without increasing the length of either the combustion or flame zones. This goal is accomplished by the novel flame shape, the reaction rate which results from the coal particle size, the stirring action together with the method of dispensing coal with a high swirl characteristic and the resultant greatly shortened and broadened flame shape.

Figure 2A:
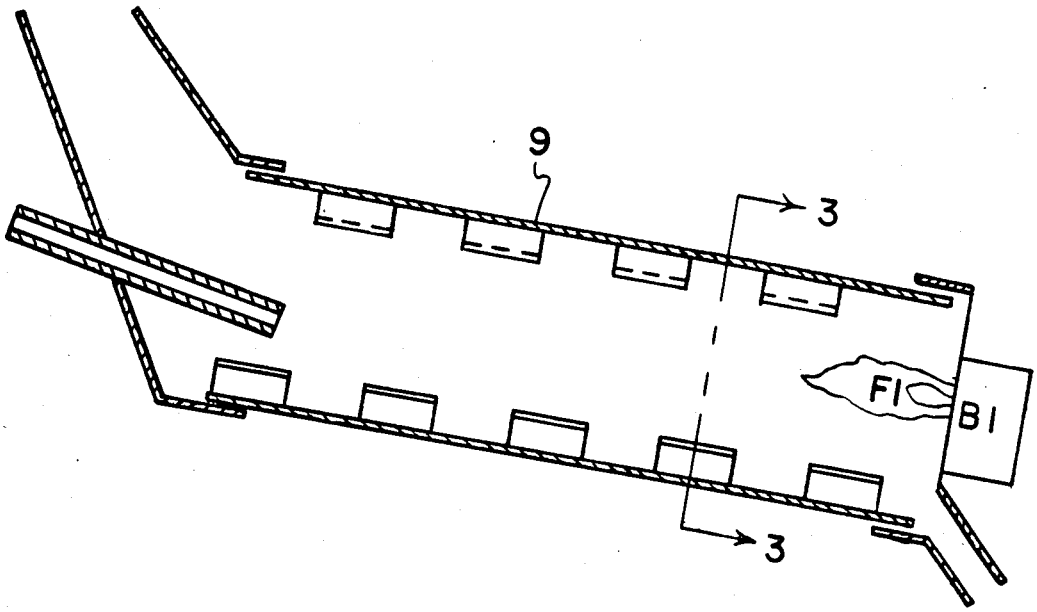
FIG. 2A is a view similar to FIG. 2 which shows an aggregate dryer in use with a pulverized coal burner formed according to this invention.
Figure 3:
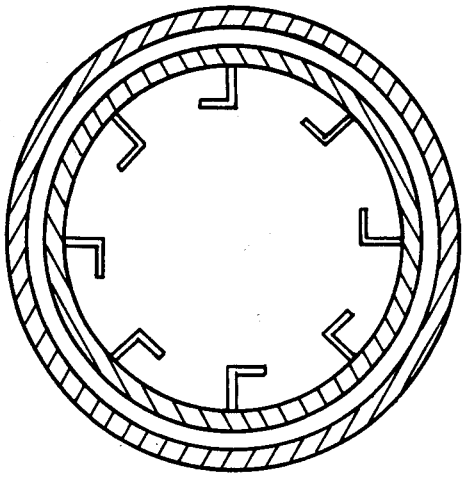
FIG. 3 is a cross sectional view taken along the line 3—3 indicated in FIG. 2A.

In accordance with this invention the structure of FIG. 2A may be utilized in conjunction with burner B1 formed according to this invention which maintains the combustion or flame zone F1 at a minimum dimension longitudinally of cylinder 9.

Figure 4:
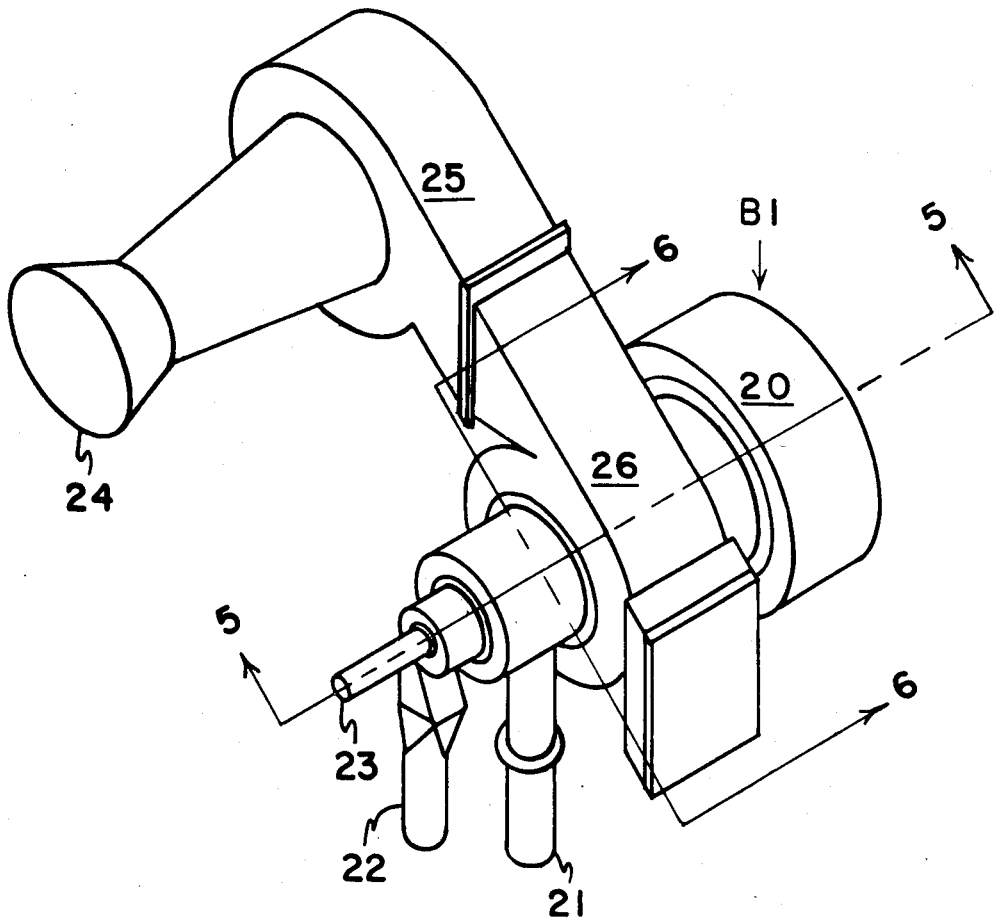
FIG. 4 is a perspective overall view of a coal burner constructed according to this invention in one form.

The coal burner B1 depicted in FIG. 4 includes a combustion chamber generally indicated at 20, an inlet 21 for primary air mixed with pulverized coal together with an inlet 22 for compressed air and an inlet 23 for liquid fuel such as oil together with an entry 24 for secondary or combustion air which is supplied via structure 25. The section of the apparatus shown in FIG. 4 which is designated generally by the numeral 26 includes concentric conduits for conveying primary air mixed with pulverized coal as well as secondary or combustion air which is supplied through a conduit concentric with the primary air conduit together with conduits for supplying gas and oil to the combustion chamber 20.

Figure 5:
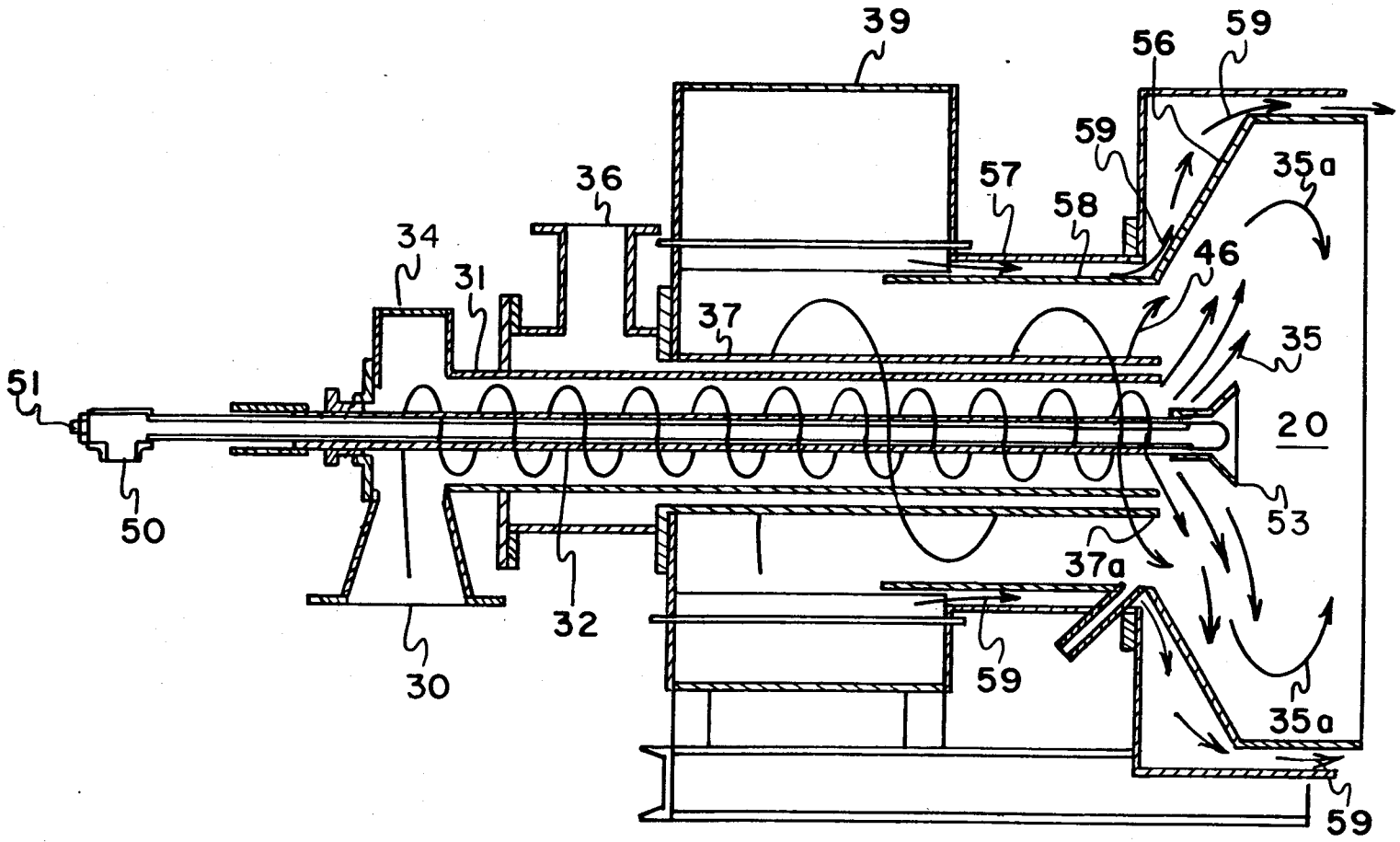
FIG. 5 is a longitudinal cross sectional view taken along the line designated 5—5 in FIG. 4.

As is shown in FIG. 5 coal and primary air inlet 30 communicates with the interior of a conduit 31 which is of fixed length and of substantially uniform size and cross sectional configuration from end to end and within which a smaller conduit 32 is concentrically disposed. This mixture flows in a swirling spiral like manner by virtue of the configuration of the annular chamber 34 so that upon reaching the combustion chamber 20, this mixture flares transversely and generally radially outward as indicated by arrows 35.

To facilitate combustion, a gas inlet 36 is provided and communicates with the interior of conduit 37 and the exterior of conduit 31. This gas is fed directly to the combustion chamber 20 and its path upon reaching that chamber is in the same general direction as that indicated by arrows 35. The gas nozzle **37*a* is disposed at the center of the outlet end of conduit 58** and aids in mixing the combustion components.

Figure 6:
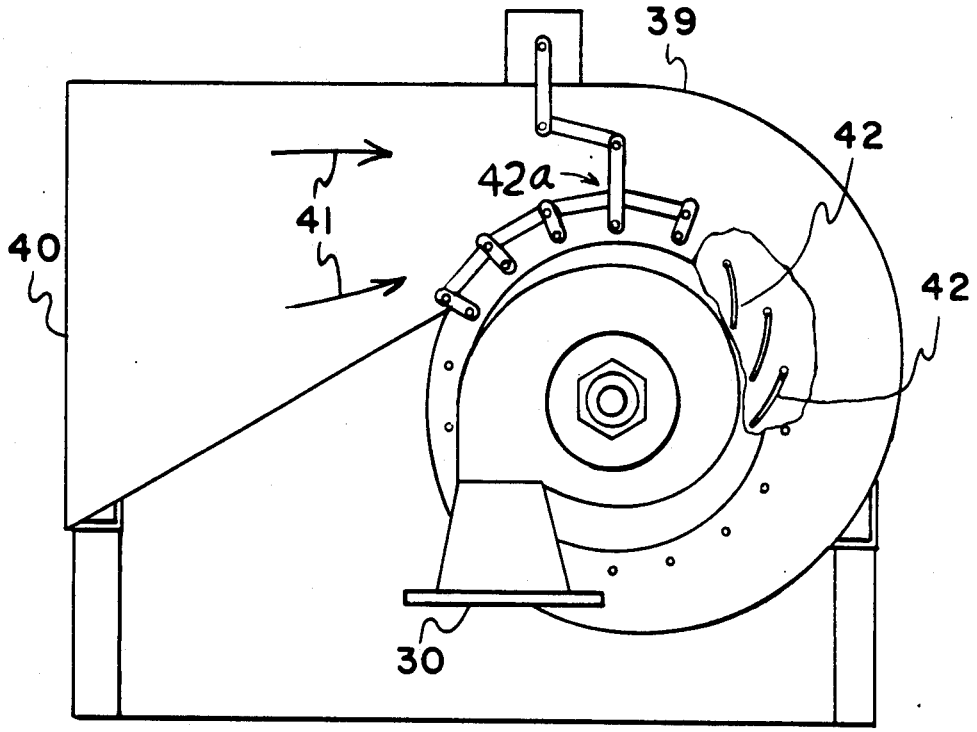
FIG. 6 is an end view partially broken away and with certain parts removed for clarity from the general vantage point represented by the line 6—6 in FIG. 4.

Secondary or combustion gas enters the structure 39 shown in FIG. 6 at inlet 40 and passes generally toward the right as indicated by arrows 41 and flows radially inward through swirl veins 42 two of which are shown in the broken away area in FIG. 6. These swirl veins are adjusted by suitable linkage mechanism **42*a* and result in a substantial swirling of the secondary or combustion air within the housing 39. This swirling or spiral like motion is indicated by the arrows 43 in FIG. 7 so that upon entry of the combustion air from housing 39 into conduit 45 and thence into the combustion chamber 20, the combustion air flows outwardly as indicated by the arrows 46. Similar action as explained is represented by the arrows 35** in conjunction with the primary air and pulverized coal mixture. During this phase of the burner operation, substantial intermingling and mixing of the combustion or secondary air with the primary air and coal mixture takes place due in part at least to centrifugal force due to swirling of these quantities. This swirling action limits the length from left to right in a longitudinal direction of the flame while simultaneously allowing the flame to expand laterally.

As shown in FIG. 5, compressed air enters the port 50 while oil or other liquid fuel enters port 51 and is conveyed along conduit 32 to the combustion chamber 20. Of course this material facilitates ignition and continued burning.

For the purpose of aiding in the lateral movement of the quantities as indicated by the arrows 35 and 46, a diffuser 53 may be provided. The effect of the structure shown and described in FIGS. 5 and 6 is to establish a low pressure region substantially below atmospheric pressure in the region of diffuser 53. This low pressure region tends to aid in causing the combustible materials and air to flow inwardly as indicated by the arrows **35*a***, thus further tending to reduce the longitudinal dimension of the flame.

For the purpose of cooling the combustion chamber 20, a metallic housing 56 is disposed about the combustion chamber housing and cooling air is supplied through the passage defined by housing structure 57 and concentric inner conduit 58. Cooling air for this passage flows in the direction of the arrows 59 and is derived from the housing 39.

Figure 7:
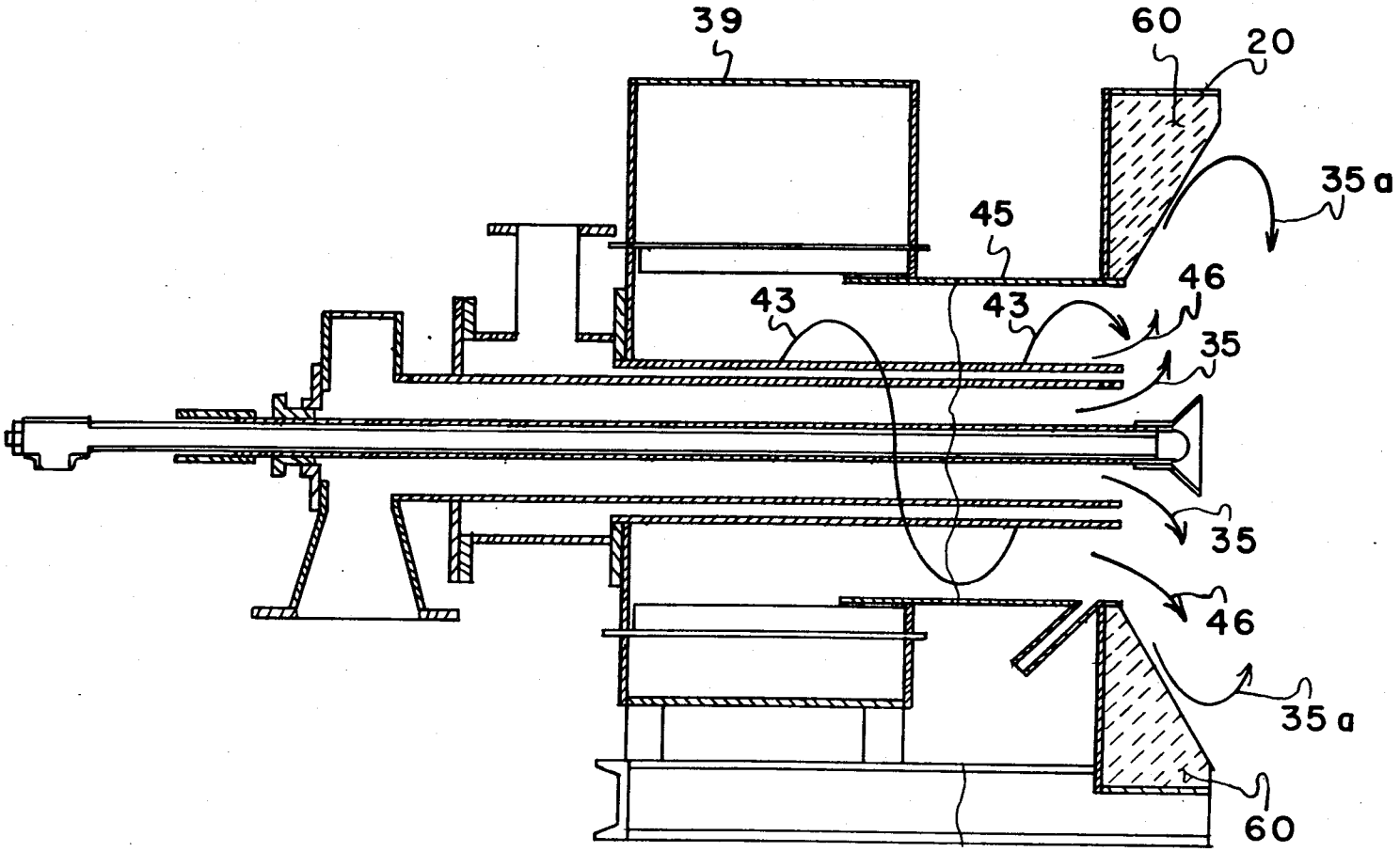
FIG. 7 is a cross sectional view similar to FIG. 5 which represents a modification of the invention and FIG. 8 is a cross sectional view of a portion of the structure such as is shown in FIGS. 5 and 7 and which shows a second modification of the invention.

If desired the cooling system shown in FIG. 5 may be eliminated using the structure shown in FIG. 7. In FIG. 7 refractory insulating material 60 may be employed if desired and renders unnecessary the use of cooling air and the structure associated therewith as shown in FIG. 5.

Figure 8:
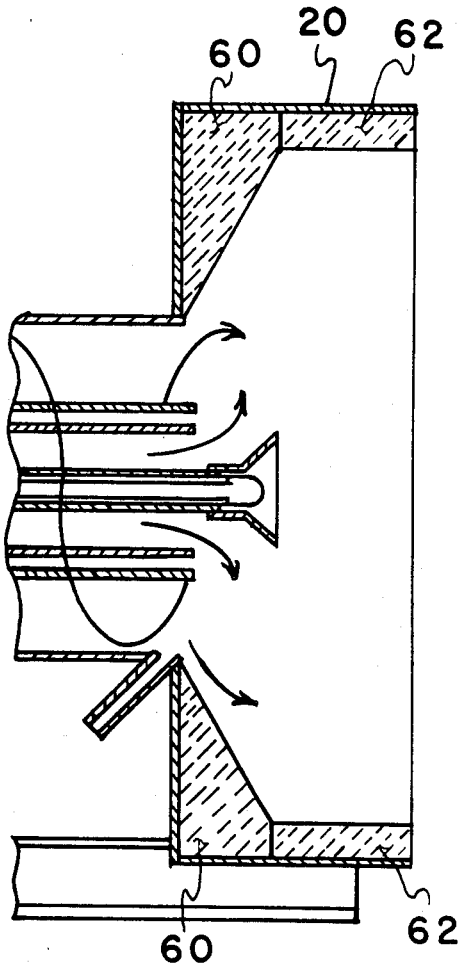

In addition the structure shown in FIG. 7 may be further modified as shown in FIG. 8 by the addition of a cylindrical lip 62 which forms a continuation of refractory insulating material 60.

INDUSTRIAL APPLICABILITY

According to this invention, a pulverized coal burner is provided which is capable of operating in conjunction with various types of apparatus such as aggregate or drum dryers, sand dryers, air heaters, furnaces, etc. and which may utilize relatively inexpensive coal by burning such coal at temperatures substantially below temperatures which heretofore have been necessary but which also may operate at higher temperatures if need be by means of appropriate adjustments.

I claim:

1. A coal burner comprising a combustion chamber, a primary elongated coal conveyer conduit having an entry end and an outlet end and being of fixed length and of substantially uniform cross sectional configuration from end to end and its outlet end having a transverse dimension which is less than the corresponding dimension of said combustion chamber and which is in communication with said combustion chamber and arranged to convey a primary mixture of air and pulverized coal to said combustion chamber, means for swirling said mixture of air and pulverized coal about the longitudinal axis of said primary coal conveyor conduit, a secondary air conveyor conduit having an outlet end in communication with said combustion chamber and arranged in generally concentric relation to said outlet end of said coal conveyor conduit for supplying combustion air to said combustion chamber, means for swirling combustion air in said secondary air conveyor conduit about the longitudinal axis thereof only in the same direction as angular swirling of said primary mixture of air and pulverized coal so as to cause such air to diverge outwardly in said combustion chamber thereby to establish a tornado-like configuration of said combustion air and said mixture in said combustion chamber and to enhance intermingling of air supplied to said combustion chamber by said air conveyor conduit and said primary mixture of air and pulverized coal supplied to said combustion chamber by said primary coal conveyor conduit and the ratio of angular momentum flux to the axial momentum flux of said mixture of air and pulverized coal is in excess of 0.6 and the ratio of the angular momentum flux to the axial momentum flux of said combustion air is at least 0.6, and a diffuser of generally conical configuration fixedly positioned in said combustion chamber downstream of the outlet ends of said primary coal conveyor conduit and said secondary air conveyor conduit to aid in lateral movement of quantities discharged from said primary coal conveyor conduit and said secondary air conveyor conduit.

2. A coal burner according to claim 1 wherein a low pressure region is established within said tornado-like configuration of said combustion air to facilitate recirculation thereof.

3. A coal burner according to claim 1 wherein said outlet end of said secondary air conveyor conduit is disposed about said outlet end of said primary coal conveyor conduit.

4. A coal burner according to claim 1 wherein said combustion chamber includes a wall having an opening with which said coal conveyor outlet and said air conveyor outlet communicate and wherein said wall is of an outwardly flaring configuration about said opening so that wall jet attraction of said wall aids in establishing a flame of tornado-like configuration.

5. A coal burner according to claim 4 wherein said wall is of conical configuration.

6. A coal burner according to claim 1 wherein fuel oil is supplied to said combustion chamber along a conduit which is coaxial with said coal conveyor conduit and whose outlet communicates with said combustion chamber to facilitate dispersal thereof into said tornado-like configuration of combustion air.

7. A coal burner according to claim 1 wherein fuel gas is supplied to said combustion chamber and into said tornado-like configuration of combustion air and of said mixture.

8. A coal burner according to claim 1 wherein the walls of said combustion chamber are formed of heat resistant refractory material.

9. A coal burner according to claim 1 wherein the walls of said combustion chamber are formed to metal and wherein an air cooling chamber is disposed thereabout.

10. A coal burner according to claim 9 wherein cooling air is supplied to said cooling chamber from said air conveyor conduit upstream from the outlet thereof.

11. A coal burner according to claim 1 wherein the part of said combustion chamber which is remote from said coal conveyor outlet and said air conveyor is cylindrical and wherein the axis thereof is coaxially disposed with the axes of said primary coal conveyor conduit and said secondary air conveyor conduit.

12. A coal burner according to claim 1 wherein said means for swirling combustion air comprises a plurality of adjustable swirl vanes for controlling the swirl momentum of said combustion air.

13. A coal burner according to claim 12 wherein means are provided for controlling the momentum of said combustion air and wherein control of said swirl vanes is dependent upon the momentum of said combustion air.

14. A coal burner according to claim 11 wherein a liquid fuel atomizer is disposed within said diffuser to facilitate combustion.

* * * * *